US011017647B2

(12) United States Patent
Johan et al.

(10) Patent No.: US 11,017,647 B2
(45) Date of Patent: May 25, 2021

(54) REMOTE MONITORING SYSTEM

(71) Applicant: Carrier Corporation, Palm Beach Gardens, FL (US)

(72) Inventors: Ron Johan, Queens Park (AU); Gabriel Daher, Long Point (AU); Daniel Ming On Wu, Chatswood (AU)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/317,346

(22) PCT Filed: Jul. 11, 2017

(86) PCT No.: PCT/US2017/041455
§ 371 (c)(1),
(2) Date: Jan. 11, 2019

(87) PCT Pub. No.: WO2018/013516
PCT Pub. Date: Jan. 18, 2018

(65) Prior Publication Data

US 2019/0295392 A1 Sep. 26, 2019

Related U.S. Application Data

(60) Provisional application No. 62/362,197, filed on Jul. 14, 2016.

(51) Int. Cl.
*G08B 13/196* (2006.01)

(52) U.S. Cl.
CPC . *G08B 13/19656* (2013.01); *G08B 13/19667* (2013.01)

(58) Field of Classification Search
CPC ..... G08B 13/19656; G08B 13/19667
See application file for complete search history.

(56) References Cited

U.S. PATENT DOCUMENTS 5,689,442 A 11/1997 Swanson et al.
5,926,210 A * 7/1999 Hackett ..... G08B 13/19641 348/150

(Continued)

FOREIGN PATENT DOCUMENTS

CN 105187781 A 12/2015
WO 2009029590 A1 3/2009

(Continued)

OTHER PUBLICATIONS

International Search Report and Written Opinion for application PCT/US2017/041455, dated Nov. 7, 2017, 12 pages.

(Continued)

*Primary Examiner* — Ryan W Sherwin
(74) *Attorney, Agent, or Firm* — Cantor Colburn LLP

(57) ABSTRACT

A method and system for remote monitoring are provided. The system includes a network including a plurality of communication points that provide a path of communication between connected devices, wherein the network is adapted to communicate via internet resources, a video device that is communicatively connected using the network an image/alarm converter that is communicatively connected to the video device using the network, and a proprietary router in the network through which the video device is able to connect to the image/alarm converter using a secure communication tunnel established by the proprietary router over the network.

19 Claims, 6 Drawing Sheets

(56) References Cited

U.S. PATENT DOCUMENTS

| | | | | |
|---|---|---|---|---|
| 6,970,183 | B1 | 11/2005 | Monroe | |
| 7,495,687 | B2 | 2/2009 | Dumas et al. | |
| 7,805,719 | B2 | 9/2010 | O'Neill | |
| 8,121,078 | B2 | 2/2012 | Siann et al. | |
| 8,520,068 | B2 | 8/2013 | Naidoo et al. | |
| 8,824,487 | B1 | 9/2014 | Ray | |
| 8,892,699 | B2 | 11/2014 | Mann | |
| 9,026,648 | B1 | 5/2015 | Slavin | |
| 9,131,257 | B2 | 9/2015 | Russo et al. | |
| 9,153,111 | B2 | 10/2015 | Trundle et al. | |
| 9,282,297 | B2 | 3/2016 | Siann et al. | |
| 9,307,067 | B2 | 4/2016 | Debates et al. | |
| 2006/0177114 | A1* | 8/2006 | Tongdee ..... | G16H 30/40 382/128 |
| 2006/0282886 | A1 | 12/2006 | Gaug | |
| 2009/0031381 | A1 | 1/2009 | Cohen et al. | |
| 2010/0245582 | A1 | 9/2010 | Harel | |
| 2012/0075469 | A1 | 3/2012 | Oskin et al. | |
| 2013/0166711 | A1 | 6/2013 | Wang | |
| 2014/0253316 | A1 | 9/2014 | Addy et al. | |
| 2014/0266685 | A1 | 9/2014 | Brueggen et al. | |
| 2014/0354821 | A1 | 12/2014 | Monroe | |
| 2015/0029335 | A1 | 1/2015 | Kasmir et al. | |
| 2015/0077553 | A1 | 3/2015 | Dawes | |
| 2015/0149991 | A1 | 5/2015 | Chen et al. | |
| 2015/0301526 | A1 | 10/2015 | Tjandra | |
| 2016/0105406 | A1 | 4/2016 | Smith et al. | |
| 2016/0105644 | A1 | 4/2016 | Smith et al. | |

FOREIGN PATENT DOCUMENTS

| | | | |
|---|---|---|---|
| WO | 2009107000 | A2 | 9/2009 |
| WO | 2016085727 | A1 | 6/2016 |

OTHER PUBLICATIONS

SecurityGem, "Canary vs. iSmartAlarm vs. Piper Home Security", available at: http://www.securitygem.com/canary-vs-ismartalarm-vs-piper-home-security , Nov. 19, 2015, 7 pages.

Singtel, "Home LIVECam (Pan, Tilt & Zoom)" available at: http://www1.singtel.com/personal/internet/addons/homelivecam/detail.html accessed: Jan. 11, 2019, 5 pgs.

European Search Report for Application No. 17740889.5; dated Jan. 14, 2021; 6 Pages.

* cited by examiner

REMOTE MONITORING SYSTEM

TECHNICAL FIELD

The subject matter disclosed herein generally relates to improvements in remote monitoring systems and, more particularly, to improvements in video remote monitoring systems.

DESCRIPTION OF RELATED ART

There are a number of operational issues with modern video surveillance systems. For example, video surveillance systems are often unmonitored with the result that failure of any device, such as camera sensors, is only detected when the video images are required to be monitored.

Another operational issue is that current video surveillance systems operate by having live video streams or video clips sent over the internet in an unencrypted manner presenting a security risk. Particularly, if one can determine where across the internet the video is being transmitted, there is little to no further protection to stop an unwanted user from accessing the unprotected video feed. Particularly, merely locating the transmission path is all that is necessary in many cases to gain access. Thus, a reliance on disorganized signal anonymity transmission is all that currently protects surveillance footage.

Further, another example of an operational issue with modern video surveillance system includes considerations dealing with the installation of the system components. For example, the installation of internet protocol (IP) video systems requires configuration of the customer's internet firewall, which is often beyond the ability of the installer. Further, the multitude of video formats, and signal formats that can be generated from all the different video devices on the market currently means that only select proprietary cameras can be used that generate the specific type and format of video and data files that the security automation system providing the monitoring of the service can understand.

Accordingly, there is a desire for improvements to such video monitoring systems.

SUMMARY

According to one embodiment, A system for remote monitoring is provided. The system includes a network including a plurality of communication points that provide a path of communication between connected devices, wherein the network is adapted to communicate via internet resources, a video device that is communicatively connected using the network to an image/alarm converter that is communicatively connected to the video device using the network, and a proprietary router in the network through which the video device is able to connect to the image/alarm converter using a secure communication tunnel established by the proprietary router over the network.

In addition to one or more of the features described above, or as an alternative, further embodiments may include, wherein the video device includes a camera sensor configured to collect a video signal, and a signal processing device configured to generate an alarm signal based on the collected video signal and transmit, using the proprietary router, the video signal and associated alarm signal to the image/alarm converter through the secure communication tunnel.

In addition to one or more of the features described above, or as an alternative, further embodiments may include, wherein the image/alarm converter is configured to receive a video signal and an alarm signal from the video device and process the video signal and the alarm signal into a standard alarm signal, wherein the standard alarm signal is in a format understandable by an automation system, and wherein the automation system is configured to receive the standard alarm signal through the proprietary router using a secure communication tunnel.

In addition to one or more of the features described above, or as an alternative, further embodiments may include, wherein the video device is a stationary device that occupies a single location.

In addition to one or more of the features described above, or as an alternative, further embodiments may include, wherein the video device is attached to a mobile device.

In addition to one or more of the features described above, or as an alternative, further embodiments may include, wherein the video device operates as a stand-alone alarm system.

In addition to one or more of the features described above, or as an alternative, further embodiments may include, wherein the system includes a plurality of video devices.

In addition to one or more of the features described above, or as an alternative, further embodiments may include, further including an analytics device that is communicatively connected to the video device through the network using a secure communication tunnel established by the proprietary router.

In addition to one or more of the features described above, or as an alternative, further embodiments may include, wherein the analytics device is configured to receive the video signal and the alarm signal from the video device, and temporally compress the video signal based on the alarm signal.

In addition to one or more of the features described above, or as an alternative, further embodiments may include, wherein the analytics device temporally compresses the video signal into one or more of a single image and a short video.

In addition to one or more of the features described above, or as an alternative, further embodiments may include, wherein the automation system is located at an alarm dispatch center, and wherein the automation system is configured to validate the received alarm signal and video signal, and dispatch alarm resources in response to validation.

In addition to one or more of the features described above, or as an alternative, further embodiments may include, wherein the video device further includes a digital video recorder (DVR) connected to the camera sensor and including the signal processing device, and a customer terminal (CT) configured to communicatively connect the camera sensor and DVR to the proprietary router using the secure communication tunnel over the network.

In addition to one or more of the features described above, or as an alternative, further embodiments may include, wherein the video device further includes an associated network video recorder (NVR) configured to record the video stream generated by the associated video camera sensors and is communicatively connected to the proprietary router using the secure communication tunnel over the network, wherein the NVR may be in the form of a network attached storage (NAS) device configured to store at least the video signal and the alarm signal whereby the NVR software in running on a NAS physical device.

According to another embodiment, a method of remote monitoring is provided. The method includes receiving a video signal, at a video device, using a camera sensor of the video device, generating, using a signal processing device of the video device, an alarm signal based on the video signal, providing a secure communication tunnel over a network using a proprietary router located on the network, transmitting the video signal and the alarm signal to an image/alarm converter device using the secure communication tunnel, and generating a standard alarm signal, using the video signal and the alarm signal, wherein the standard alarm signal is in a format understandable by an automation system, and transmitting the standard alarm signal from the image/alarm converter device to the automation system through the proprietary router using the secure communication tunnel.

In addition to one or more of the features described above, or as an alternative, further embodiments may include receiving the video signal and the alarm signal at an analytics device that is located on the network and communicatively connected to the proprietary router, and temporally compressing the video signal based on the alarm signal.

In addition to one or more of the features described above, or as an alternative, further embodiments may include receiving the video signal and alarm signal at the automation system, and validating the received video signal and alarm signal at the automation system.

In addition to one or more of the features described above, or as an alternative, further embodiments may include dispatching alarm resources in response to the validation using the automation system.

According to another embodiment, a video system for remote monitoring is provided. The video system including a computer readable storage medium having program instructions embodied therewith, the program instructions executable by one or more processors of the video system to cause the one or more processors to receive a video signal, at a video device, using a camera sensor of the video device, generate, using a signal processing device of the video device, an alarm signal based on the video signal, provide a secure communication tunnel over a network using a proprietary router located on the network, transmit the video signal and the alarm signal to an image/alarm converter device using the secure communication tunnel, and generate a standard alarm signal, using the video signal and the alarm signal, wherein the standard alarm signal is in a format understandable by an automation system, and transmit the standard alarm signal from the image/alarm converter device to the automation system through the proprietary router using the secure communication tunnel.

In addition to one or more of the features described above, or as an alternative, further embodiments may include, wherein the video system further includes additional program instructions executable by the one or more processors of the video system to cause the processor to receive the video signal and the alarm signal at an analytics device that is located on the network and communicatively connected to the proprietary router, and temporally compress the video signal based on the alarm signal.

In addition to one or more of the features described above, or as an alternative, further embodiments may include, wherein the video system further includes additional program instructions executable by the one or more processors of the video system to cause the processor to receive the video signal and alarm signal at the automation system, validate the received video signal and alarm signal at the automation system, and dispatch alarm resources in response to the validation using the automation system.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the present disclosure are apparent from the following detailed description taken in conjunction with the accompanying drawings in which.

DETAILED DESCRIPTION

Figure 1A:
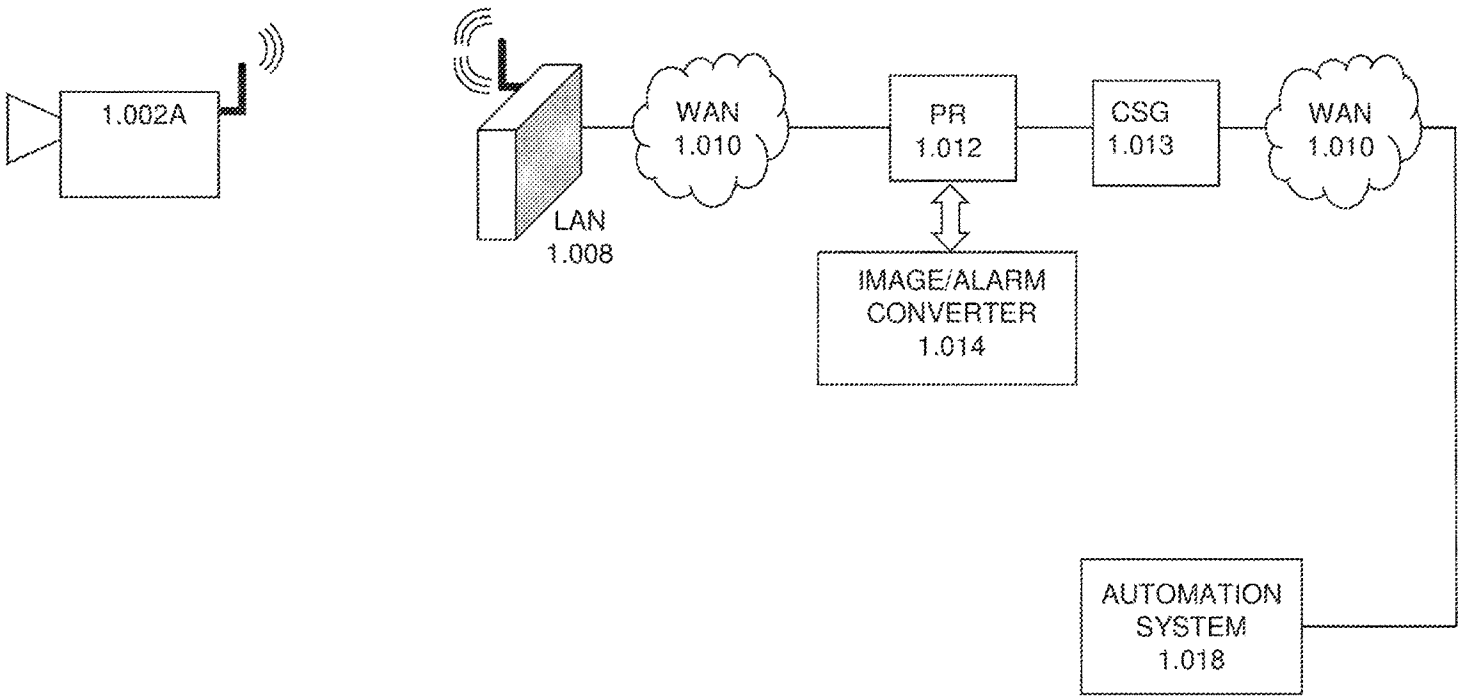
FIG. 1A illustrates a block diagram illustrating basic elements of a network architecture for a remote monitoring system according to one or more embodiments of the disclosure.

One or more embodiments described herein are directed to a system and/or method for managing remote monitoring using video surveillance. The monitoring system includes a network that includes a plurality of communication points that provide a path of communication between connected devices. Additionally, the network is adapted to communicate via internet resources. The monitoring system also includes at least one video device that is communicatively connected using the network. Further, the monitoring system includes an image/alarm converter that is communicatively connected to the video device using the network. The connections between the elements of the monitoring system are made using a proprietary router that is included as part of the system. The proprietary router is in the network. Further, the video device is able to connect to the image/alarm converter using a secure communication tunnel established by the video device to the proprietary router over the network. The tunnel implementation uses outgoing connections from the edge device to the proprietary router avoiding the need for site specific router configurations such as using a static IP address and/or port forwarding or using other non-secured IP device location schemes such as dynamic DNS.

In accordance with one or more embodiments, the proprietary router is one which is accessible via a proprietary message, such as a video signal and/or alarm signal from the video device, from an associated edge device, such as a video device (1.002A) or a customer terminal (1.006), and which processes such proprietary messages in a predetermined manner. For example, the proprietary router can communicate with an image/alarm converter to process received video signal by standardizing them to a format that is understood by the automation system. Further, the proprietary router may be configured to connect specified terminals to associated terminals. For example the proprietary router can connect the video device to an analytics device, network storage, and/or an image/alarm converter. The proprietary router may be adapted to terminate an incoming tunnel and establish an outgoing tunnel. An associated edge device may have access to a dedicated port of a proprietary router. Proprietary routers can be accessed via a public network.

According to one or more embodiments, a proprietary router can be adapted to be associated with not only a local area network (LAN) but also a wide area network (WAN), while remaining under the control of a proprietor of a dedicated communication network, rather than being under the control of the WAN operator. The proprietary router can have proprietary interfaces adapted to communicate with associated terminals. The network can include one or more proprietary routers.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Embodiments described herein are directed to a video surveillance system that provides remote monitoring. For example, according to one or more embodiments, a customer terminal can be provided which connects to a video device and sends video and status via the internet through an encrypted IP tunnel established to a network-based proprietary router which in turn delivers the video to the customer's smart phone and/or a central monitoring station to be used for video verification. In addition, the proprietary router routes the alarm messages from the edge device to the image/alarm converter which carries out protocol conversion on the alarms from the video devices into a format compatible with standard central monitoring stations. This protocol conversion, or standardization, allows the central monitoring station to respond to faults in the video system and access live or recorded video. Further, the tunnel allows the central monitoring station to remotely manage the equipment by, for example, remotely modifying configuration or remotely upgrading the firmware.

For example, turning now to FIG. 1A, a block diagram illustrating basic elements of a network architecture for a remote monitoring system is shown in accordance with one or more embodiments. The remote monitoring system includes a video device 1.002A that is installed to monitor a user designated area. For example, the camera can be a security camera installed to monitor a point of sale in a retail establishment. According to another embodiment, the video device 1.002A is a camera installed in a residence to monitor a door, window, room, and/or valuable. According to yet another embodiment, the camera may be mounted within a vehicle to monitor the activity and travel of the vehicle. Further, the video device can be mounted in a mobile device, such as a cell phone or tablet, and can be activated intermittently by the mobile device user to capture images or videos for analysis to see if any triggering image data is present that would warrant the generating of an alarm signal by the video device.

Further, as shown, the video device 1.002A communicates wirelessly with a local area network (LAN) 1.008 and then through a wide area network (WAN) 1.010 to reach resources that are located elsewhere in a network. Alternatively, according to another embodiment, the video device can be wired directly and communicate using the physical wire such as, for example, a cat5e, cat6, etc. The network can be a private network or can extend over the internet. As shown the video monitoring system also includes a proprietary router 1.012 that is able to communicate with the video device 1.002A over the network resources. The video device 1.002A is able to communicate by creating a secure communication channel between the proprietary router 1.012 and itself through the network elements as shown. Further the proprietary router 1.012 can create secure communication tunnels with other elements connected over the network such as the image/alarm converter 1.014 and an automation system 1.018 via the central station gateway (CSG) 1.013. According to one or more embodiments, the automation system 1.018 is located off-site outside the internet resources. For example the automation system 1.018 can be a security dispatch center that includes workstations and users that watch and monitor provided alarm and video feeds and dispatch security resources such as police, firemen, and ambulances depending on what is validated by a monitoring user on the video feeds.

Figure 1B:
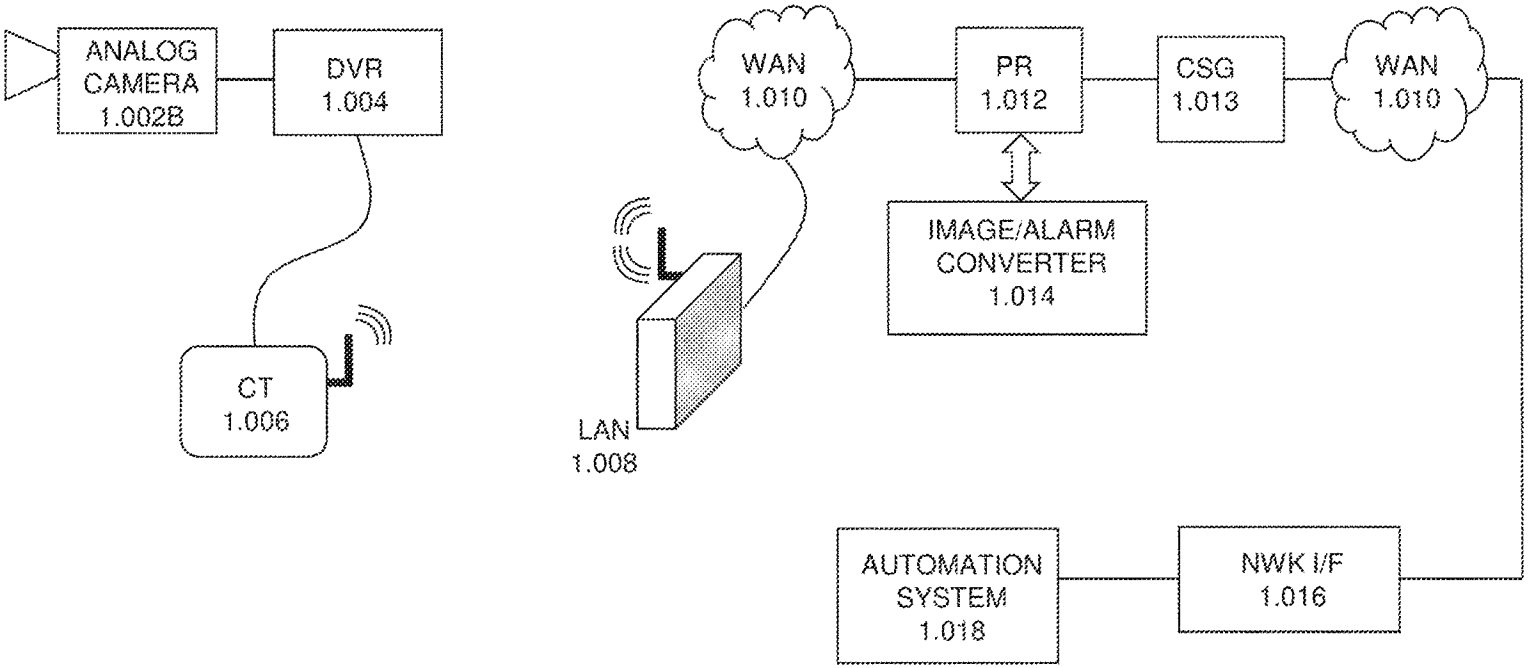
FIG. 1B illustrates a block diagram illustrating additional elements of the network architecture for the remote monitoring system according to one or more embodiments of the disclosure.

FIG. 1B illustrates a block diagram illustrating additional elements of the network architecture for the remote monitoring system according to one or more embodiments of the disclosure. The remote monitoring system shown includes a local area network (LAN) 1.008 connected to a wide area network (WAN) 1.010 that makes up the network which includes a number of resources. For example, the remote monitoring system includes a proprietary router (PR) 1.012 that is connected to a central station gateway (CSG) 1.013 which are connected to an automation system 1.018 using a network interface (NWK I/F) 1.016. The PR 1.012 can further include or be connected to an image/alarm converter 1.014. The image/alarm converter 1.014 converts image signals and alarm signals received from the video device by converting them to a standard understood by the automation system 1.018. This can be accomplished by, for example, protocol conversion or other standardization techniques.

FIG. 1B also includes a video device that includes a number of elements. Specifically, the video device in this embodiment includes one or more analog cameras 1.002B, a digital video recorder (DVR) 1.004, and a customer terminal (CT) 1.006. The DVR 1.004 includes an analog to digital converter (A/D converter) that converts the signal received from the one or more analog cameras into digital video signals that are stored in the DVR 1.004 and can be accessed as desired from the DVR 1.004. The CT 1.006 provides communication components that can transmit the digital video signals being recorded by or previously stored in the DVR 1.004 to the proprietary router 1.012 through the secure tunnel created by the CT 1.006 to the proprietary router 1.012. The tunnel can be encrypted and can pass through, for example, the WAN 1.010 and the LAN 1.008 which may be wireless. The proprietary router can use another encrypted data tunnel that connects to other elements where the received video signal and alarm signal are transmitted or processed. For example, the PR 1.012 can be connected to the CSG 1.013 and hence to the automation system 1.018 to which the standardized video signal and alarm signal can be transmitted. Further, the PR 1.012 can include, or be connected to, an image/alarm converter 1.014 that converts the received video signal and alarm signal when necessary to a format understood by the destination element. As noted, the destination element can be the automation system 1.018 or some other element such as a user's mobile device.

Figure 2:
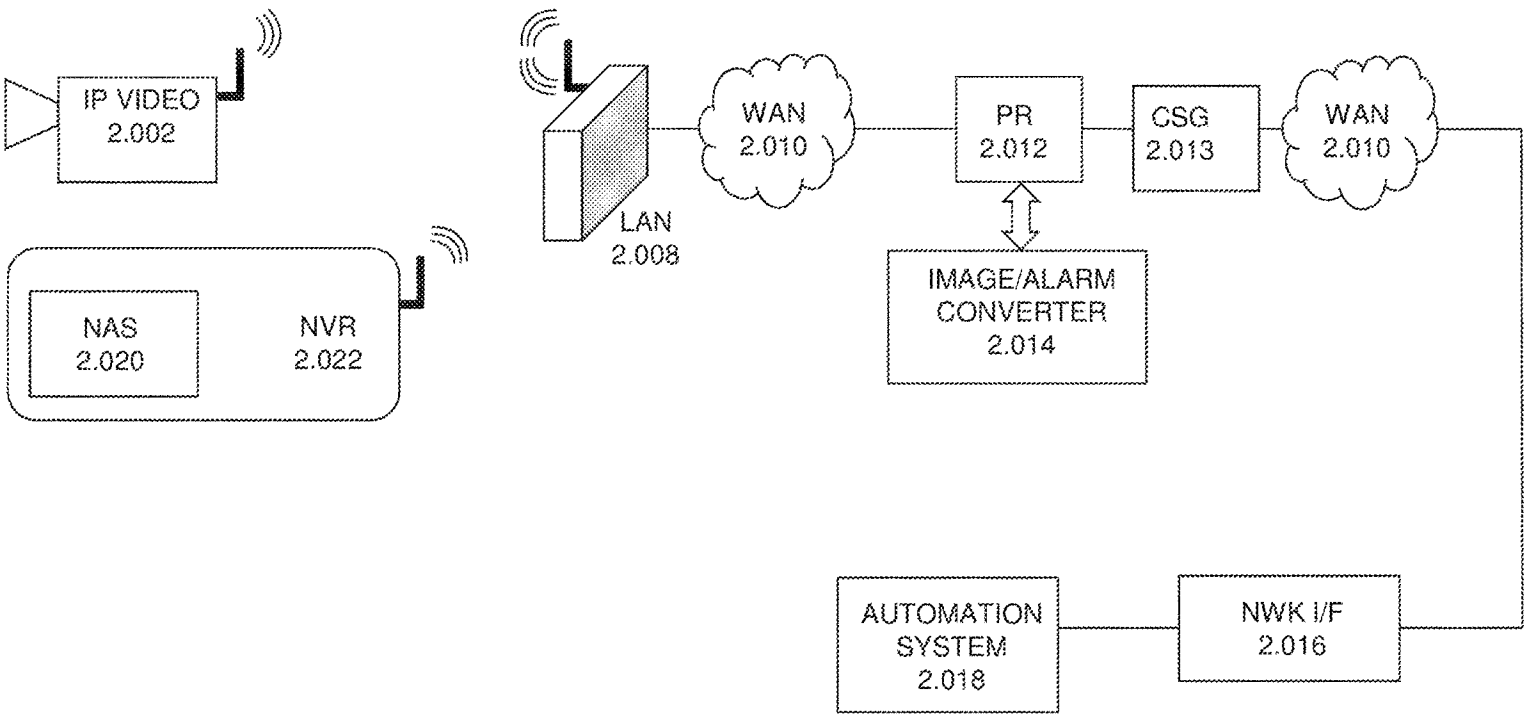
FIG. 2 illustrates a block diagram illustrating elements of a network architecture for a remote monitoring system according to one or more embodiments of the disclosure.

FIG. 2 illustrates a block diagram illustrating elements of network architecture for a remote monitoring system according to one or more embodiments of the disclosure. Similar to FIGS. 1A and 1B, FIG. 2 includes a network that is made up of a number of elements as shown. According to other embodiments the network can include a number of additional elements such as display units, user devices, mobile user devices, signal processing devices, analytic devices, storage devices, additional proprietary routers, as well as other devices. As shown, and in accordance with an embodiment, the network includes LAN 2.008 and WAN 2.010 resources as well as one or more proprietary routers 2.012, a central station gateway (CSG) 2.013, and an image/alarm converter 2.014. The system also includes an automation system 2.018 and a network interface (NWK I/F) 2.016 that is configured to connect the automation system 2.018 to network resources. According to an embodiment, the network interface (NWK I/F) 2.016 may be implemented as software executing on the computer server used by the automation system (2.018).

Further, the video monitoring system includes a video device that includes a number of elements. Particularly, the video device includes an IP video camera 2.002 that can communicate via an IP network and via an IP tunnel that it establishes to the PR (2.012). The video device also includes a network video recorder (NVR) 2.022 that includes network attached storage (NAS) 2.020 that can also communicate via an IP network and via an IP tunnel that it establishes to the PR (2.012). The NVR 2.022 and included NAS 2.020 include tunneling software loaded on the device to allow for tunneling with the proprietary router 2.012. Thus, the NVR 2.022 can receive the video signal from the IP video camera 2.002, process and generate an alarm signal based on the video signal or for other reasons such as a hardware malfunction, and then transmit those signals to the PR 2.012 through the provided secure encrypted tunnel. The PR 2.012 may then convert the image signal and alarm signal using the image/alarm converter 2.014. The availability of the tunnel to maintain communications is monitored by the PR (2.012) which may generate an alarm message to the automation system (2.018) in the event that the tunnel is unable to support end-to-end communication. It will be apparent to those of ordinary skill in the art that the tunneling software embedded in the edge devices monitors the availability of the tunnel for communication with the PR (2.012) and makes ongoing attempts for its re-establishment in the event of it becoming unavailable.

Figure 3A:
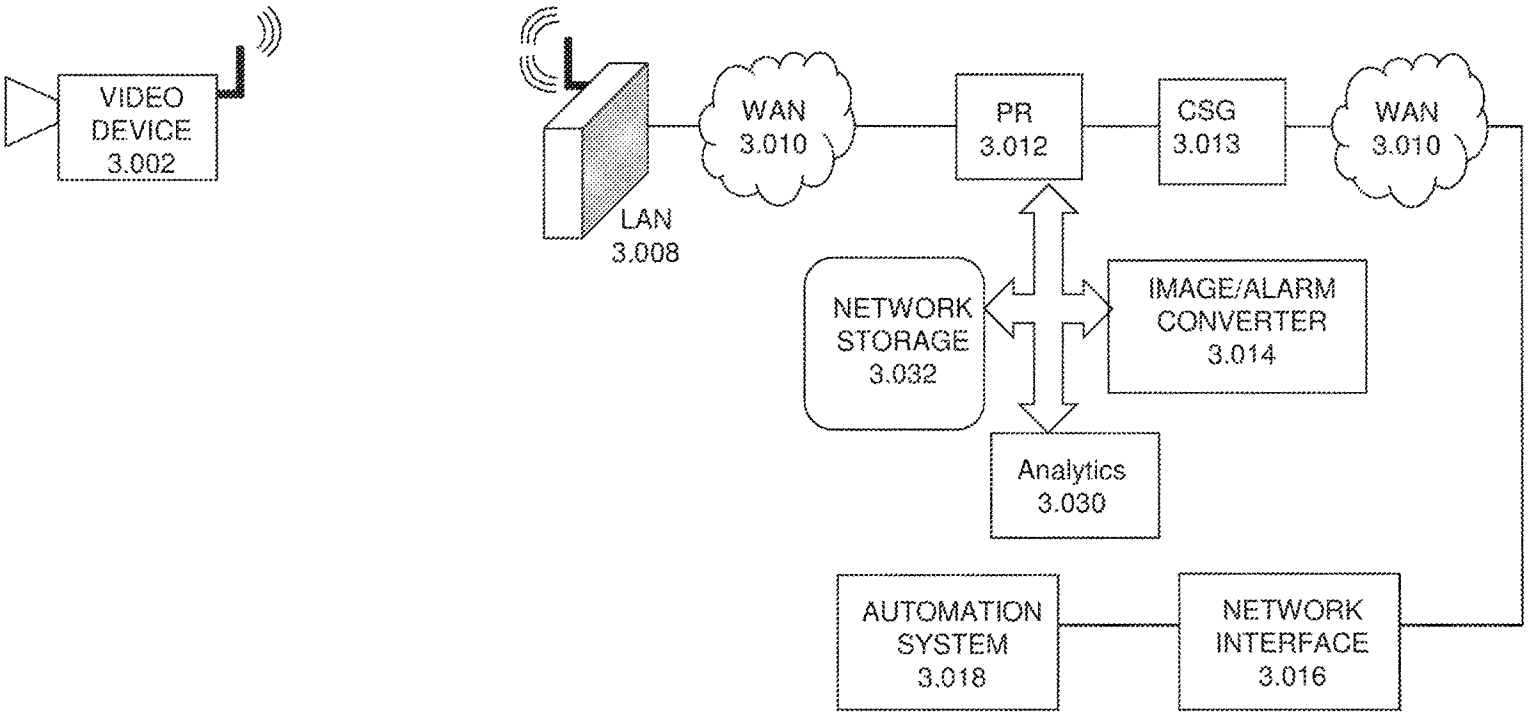
FIG. 3A illustrates a block diagram illustrating elements of a network architecture for a remote monitoring system according to one or more embodiments of the disclosure.

FIG. 3A illustrates a block diagram illustrating elements of a network architecture for a remote monitoring system according to one or more embodiments of the disclosure. The remote monitoring system includes a video device 3.002 that can communicate over a network with the other resources of the remote monitoring system. Specifically, the other resources in a proprietary router 3.012 that includes, or is connected to, network storage 3.032, analytics 3.030, and an image/alarm converter 3.014. The remote monitoring system also includes a central station gateway (CSG) 3.013. The network uses resources such as wide area network (WAN) 3.010 connections as well as at least one local area network (LAN) 3.008 to connect to the video device 3.002. The remote monitoring system also includes a network interface 3.016 that connects an automation system 3.018 to the network, specifically the proprietary router 3.012 and the CSG 3.013. The analytics 3.030 can include a number of different processing devices that are configured to receive the video signal and/or the alarm signal from the video device 3.002 through a secure encrypted communication tunnel established by the video device 3.002 to the proprietary router 3.012. Once received, the analytics 3.030 can process the received video signal and/or alarm signal and generate one or more of a new video signal, an image, a report, a graph, data tables, or any other number of data transformation and derivations. For example, the analytics 3.030 can include a signal processing unit that temporally compresses the video signal to include the segments of the video signal that correspond to the alarm signals reducing the overall length to only cover the video portions associated with the triggering of the alarm. The temporal compression may result in one or more images that summarize the period of time prior to the alarm being triggered and an interval following the triggering of the alarm where the single image may be displayed in a form similar to that of a cloud chamber whereby the subject that has caused the alarm is seen as a leaving 'vapor' trail associated with the movement through the field view of the camera image sensor. The resultant one or more images being transported to the end customer's smart phone or to the central station dispatcher allows the receiving person to make a rapid determination as to the cause of the alarm and to identify the presence of an intruder. According to one or more other embodiments, the analytics 3.030 may also, or alternatively, apply object filters to determine when certain objects appear and exit the video signal.

Figure 3B:
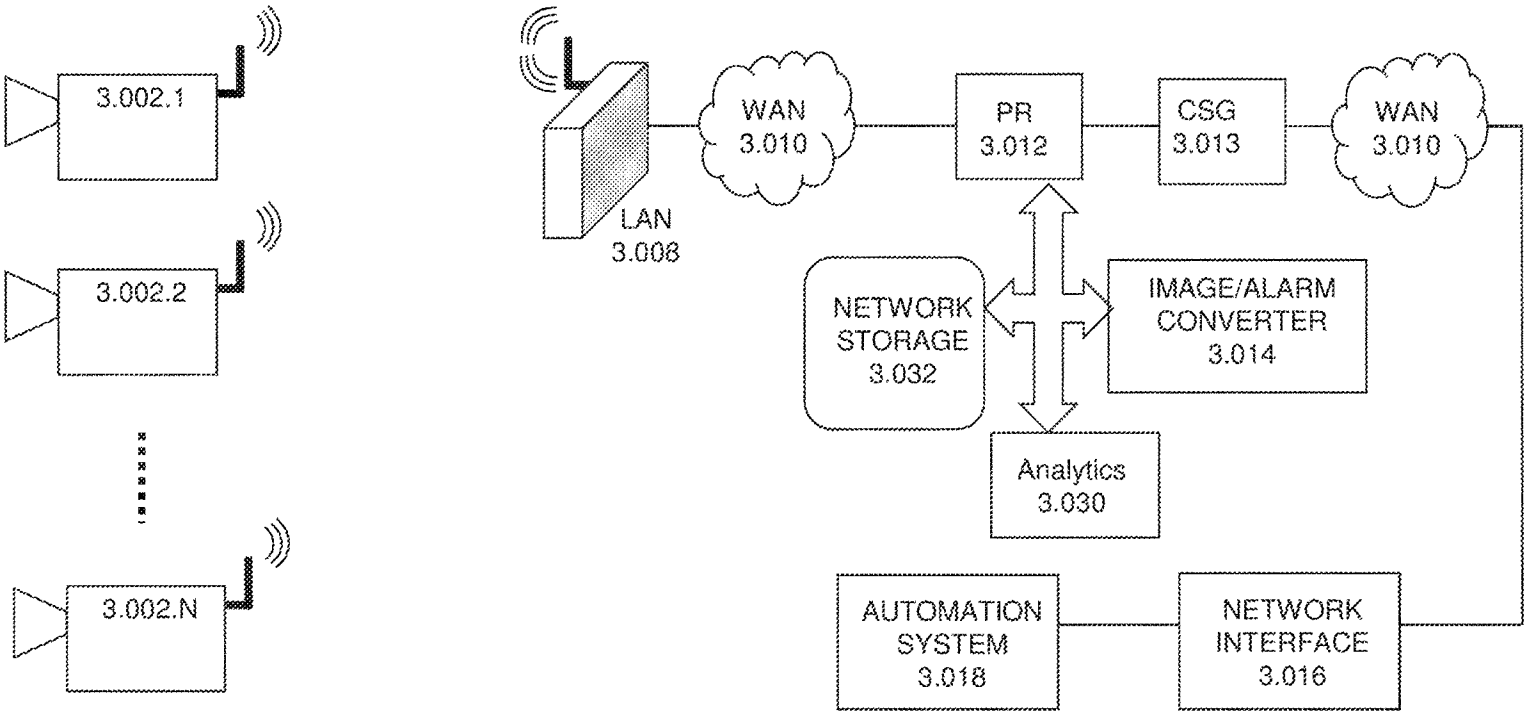
FIG. 3B illustrates a block diagram illustrating a plurality of additional elements of a network architecture for a remote monitoring system according to one or more embodiments of the disclosure.

FIG. 3B illustrates a block diagram illustrating a plurality of additional elements of a network architecture for a remote monitoring system according to one or more embodiments of the disclosure. The video monitoring system as shown includes the same elements and arrangement as FIG. 3A on the network side. Particularly, the video monitoring system includes one or more proprietary router 3.012, a central station gateway (CSG) 3.013, network storage 3.032, image/alarm converter 3.014, analytics 3.030, an automation system 3.018, network interface 3.016, as well as WAN 3.010 and LAN 3.008 elements.

Further, the video monitoring system includes not only a first video device 3.002.1 but a plurality of video devices. Particularly, as shown, the video monitoring system can include a second video device 3.002.2 and many more video devices, up to N 3.002.N each equipped with software allowing a connection to the PR (3.012) via a uniquely addressed encrypted tunnel. Each video device being monitored by the network are able to send alarm events and associated video to the automation system 3.018 as disclosed above in the event of a device malfunction or upon the detection of an alarm event through the use of video motion detection algorithms and the like.

Figure 4:
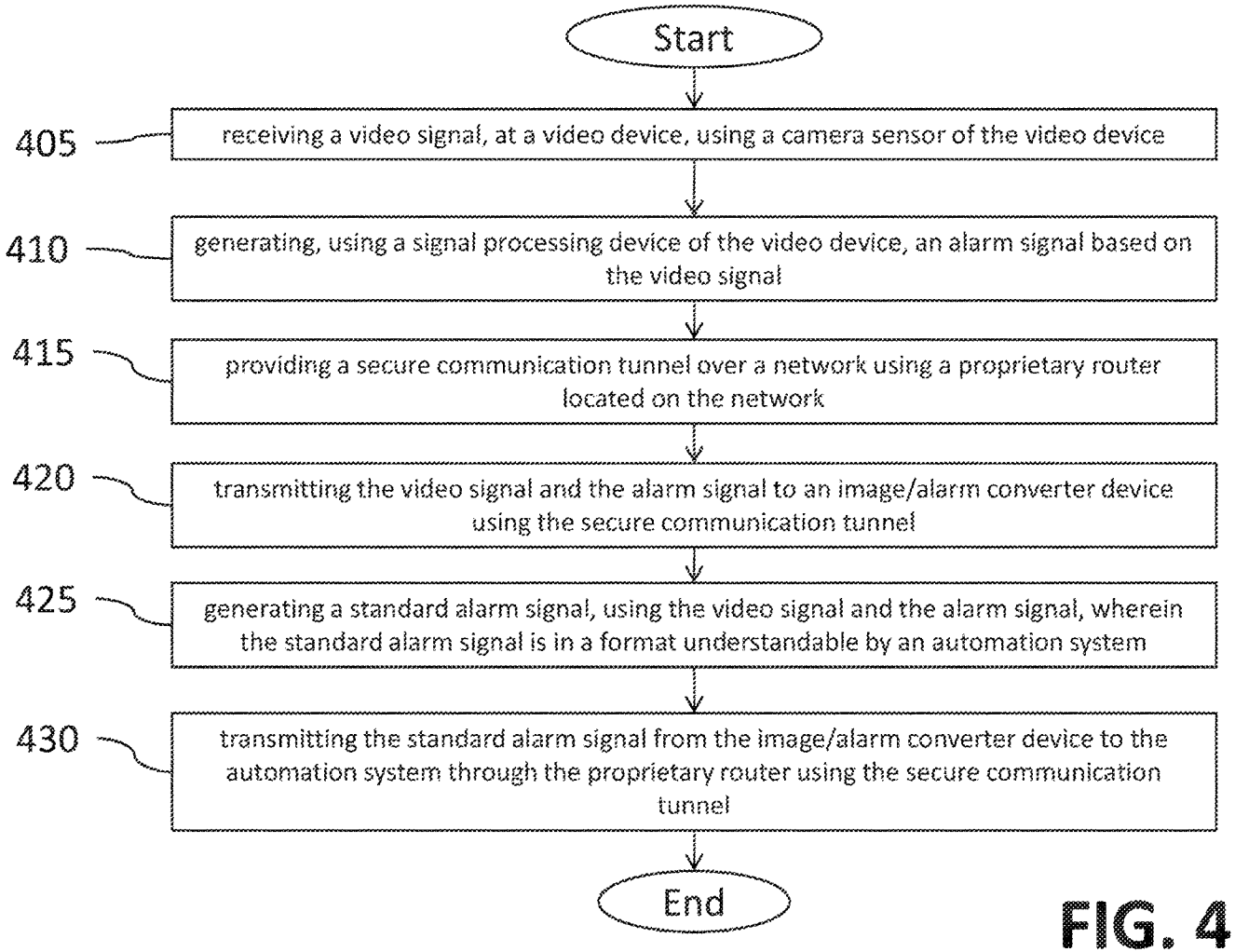
FIG. 4 illustrates a flowchart of a method for remote monitoring according to one or more embodiments of the disclosure.

FIG. 4 illustrates a flowchart of a method 400 for remote monitoring according to one or more embodiments of the disclosure. The method 400 includes receiving a video signal, at a video device, using a camera sensor of the video device (operation 405). The method 400 also includes generating, using a signal processing device of the video device, an alarm signal based on the video signal (operation 410).

The method 400 also includes providing a secure communication tunnel over a network using a proprietary router located on the network (operation 415). Further, the method 400 includes transmitting the video signal and the alarm signal to an image/alarm converter device using the secure communication tunnel (operation 420). The method 400 also includes generating a standard alarm signal, using the video signal and the alarm signal, wherein the standard alarm signal is in a format understandable by an automation system (operation 425). Further, the method includes transmitting the standard alarm signal from the image/alarm converter device to the automation system through the proprietary router using the secure communication tunnel (operation 430).

According to one or more embodiments, the method may further include receiving the video signal and the alarm signal at an analytics device that is located on the network and communicatively connected to the proprietary router. Further the method can include temporally compressing the video signal based on the alarm signal.

According to another embodiment the method can include receiving the video signal and alarm signal at the automation system, and validating the received video signal and alarm signal at the automation system. Further, the method can include dispatching alarm resources in response to the validation using the automation system.

Advantageously, embodiments described herein provide a secure, easy to install means of monitoring video devices and their connectivity which is currently not provided or provided in an unsecured manner requiring considerable IP skills to install and configure. In addition, it allows the installing company to offer the customer an equipment monitoring service using standardized alarm monitoring automation systems which generates annuity revenues.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description has been presented for purposes of illustration and description, but is not intended to be exhaustive or limited to the embodiments in the form disclosed. Many modifications and variations will be apparent to those of ordinary skill in the art without departing from the scope of the disclosure. The embodiments were chosen and described in order to best explain the principles of the disclosure and the practical application, and to enable others of ordinary skill in the art to understand various embodiments with various modifications as are suited to the particular use contemplated.

The present embodiments may be a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Java, Smalltalk, C++, or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present invention are described herein with reference to flowchart illustrations and/or block diagrams of methods, apparatus (systems), and computer program products according to embodiments. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Accordingly, the present disclosure is not to be seen as limited by the foregoing description, but is only limited by the scope of the appended claims.

What is claimed is:

1. A system for remote monitoring, the system comprising:

a network comprising a plurality of communication points that provide a path of communication between connected devices, wherein the network is adapted to communicate via internet resources;

a video device that is communicatively connected using the network;

an image/alarm converter that is communicatively connected to the video device using the network; and a proprietary router in the network through which the video device is able to connect to the image/alarm converter using a secure communication tunnel established by the proprietary router over the network;

wherein the image/alarm converter is configured to receive a video signal and an alarm signal from the video device and convert the video signal and the alarm signal into a standard alarm signal, wherein the standard alarm signal is in a format understandable by an automation system, and wherein the automation system is configured to receive the standard alarm signal through the proprietary router using a secure communication tunnel.

2. The system of claim 1, wherein the video device comprises:

a camera sensor configured to collect a video signal; and a signal processing device configured to generate an alarm signal based on the collected video signal and transmit, using the proprietary router, the video signal and associated alarm signal to the image/alarm converter through the secure communication tunnel.

3. The system of claim 2, wherein the video device further comprises:

a digital video recorder (DVR) connected to the camera sensor and comprising the signal processing device; and a customer terminal (CT) configured to communicatively connect the camera sensor and DVR to the proprietary router using the secure communication tunnel over the network.

4. The system of claim 2, wherein the video device further comprises:

a network video recorder (NVR) configured to communicatively connect the camera sensor and signal processing device to the proprietary router using the secure communication tunnel over the network, wherein the NVR comprises a local storage element configured to store at least the video signal and the alarm signal.

5. The system of claim 1, wherein the video device is a stationary device that occupies a single location.

6. The system of claim 1, wherein the video device is attached to a mobile device.

7. The system of claim 1, wherein the video device operates as a stand-alone alarm system.

8. The system of claim 1, wherein the system comprises a plurality of video devices.

9. The system of claim 1, further comprising:

an analytics device that is communicatively connected to the video device through the network using a secure communication tunnel maintained by the proprietary router.

10. The system of claim 9, wherein the analytics device is configured to receive the video signal and the alarm signal from the video device, and temporally compress the video signal based on the alarm signal.

11. The system of claim 10, wherein the analytics device temporally compresses the video signal into one or more of a single image, a composite image, and a short video.

12. The system of claim 1, wherein the automation system is located at an alarm dispatch center, and wherein the automation system is configured to validate the received alarm signal and video signal, and dispatch alarm resources in response to validation.

13. A method of remote monitoring, the method comprising:

receiving a video signal, at a video device, using a camera sensor of the video device;

generating, using a signal processing device of the video device, an alarm signal based on the video signal;

providing a secure communication tunnel over a network using a proprietary router located on the network;

transmitting the video signal and the alarm signal to an image/alarm converter device using the secure communication tunnel; and converting the video signal and the alarm signal into a standard alarm signal, wherein the standard alarm signal is in a format understandable by an automation system; and transmitting the standard alarm signal from the image/alarm converter device to the automation system through the proprietary router using the secure communication tunnel.

14. The method of claim 13, further comprising:

receiving the video signal and the alarm signal at an analytics device that is located on the network and communicatively connected to the proprietary router; and temporally compressing the video signal based on the alarm signal.

15. The method of claim 13, further comprising:

receiving the video signal and alarm signal at the automation system; and validating the received video signal and alarm signal at the automation system.

16. The method of claim 15, further comprising:

dispatching alarm resources in response to the validation using the automation system.

17. A video system for remote monitoring, the video system comprising a computer readable storage medium having program instructions embodied therewith, the program instructions executable by one or more processors of the video system to cause the one or more processors to:

receive a video signal, at a video device, using a camera sensor of the video device;

generate an alarm signal based on the video signal;

provide a secure communication tunnel over a network using a proprietary router located on the network;

transmit the video signal and the alarm signal to an image/alarm converter device using the secure communication tunnel; and converting the video signal and the alarm signal into a standard alarm signal, wherein the standard alarm signal is in a format understandable by an automation system; and transmit the standard alarm signal from the image/alarm converter device to the automation system through the proprietary router using the secure communication tunnel.

18. The video system of claim 17, wherein the video system further comprises additional program instructions executable by the one or more processors of the video system to cause the processor to:

receive the video signal and the alarm signal at an analytics device that is located on the network and communicatively connected to the proprietary router; and temporally compress the video signal based on the alarm signal.

19. The video system of claim 17, wherein the video system further comprises additional program instructions executable by the one or more processors of the video system to cause the processor to:

receive the video signal and alarm signal at the automation system;

validate the received video signal and alarm signal at the automation system; and dispatch alarm resources in response to the validation using the automation system.

* * * * *